US007290517B2

(12) United States Patent
Marchand et al.

(10) Patent No.: US 7,290,517 B2
(45) Date of Patent: Nov. 6, 2007

(54) AUTOMATIC START-UP OF AN AUXILIARY POWER UNIT

(75) Inventors: David G. Marchand, Dunlap, IL (US); David C. Orr, Dunlap, IL (US); John J. Bernardi, Chillicothe, IL (US); Jon B. Borgeson, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 11/191,138

(22) Filed: Jul. 28, 2005

(65) Prior Publication Data

US 2007/0022995 A1 Feb. 1, 2007

(51) Int. Cl.
*F02N 7/10* (2006.01)
*F02N 17/00* (2006.01)

(52) U.S. Cl. ..... 123/179.3; 123/179.19

(58) Field of Classification Search ..... 123/179.3, 123/179.19, DIG. 8, 142.5
See application file for complete search history.

(56) References Cited

U.S. PATENT DOCUMENTS 4,424,775 A * 1/1984 Mayfield et al. ..... 123/142.5 R
4,425,775 A 1/1984 Mayfield, Jr. et al.
4,448,157 A 5/1984 Eckstein et al.
4,490,620 A 12/1984 Hansen
4,762,170 A * 8/1988 Nijjar et al. ..... 165/43
4,935,689 A * 6/1990 Fujikawa et al. ..... 322/1
5,255,733 A 10/1993 King
5,331,821 A 7/1994 Hanson et al.
5,366,151 A 11/1994 King et al.
5,469,820 A 11/1995 Data et al.
5,528,901 A * 6/1996 Willis ..... 123/179.19
5,579,728 A 12/1996 Gotmalm
5,606,946 A * 3/1997 Data et al. ..... 123/198 F
5,619,956 A 4/1997 Koziara et al.
5,977,646 A 11/1999 Lenz et al.
5,977,647 A 11/1999 Lenz et al.
6,234,932 B1 5/2001 Kuroda et al.
6,242,873 B1 6/2001 Drozdz et al.
6,363,906 B1 * 4/2002 Thompson et al. ... 123/198 DB
6,470,844 B2 * 10/2002 Biess ..... 123/142.5 R (Continued)

FOREIGN PATENT DOCUMENTS

EP 1 178 458 2/2002

(Continued)

OTHER PUBLICATIONS

About Us . . . Newsroom, Thermo King Announces TriPac Auxiliary Power Unit, http://www.thermoking/com.aboutus/newsroom/pressDisplay.asp?id=329, Apr. 14, 2005, p. 1

*Primary Examiner*—Stephen K. Cronin
*Assistant Examiner*—Arnold Castro
(74) *Attorney, Agent, or Firm*—Finnegan, Henderson, Farabow, Garrett & Dunner

(57) ABSTRACT

An auxiliary power unit automatic start-up system is configured to assist a main engine start of a machine. The auxiliary power unit automatic start-up system may include an auxiliary power unit and a controller. The controller may monitor a parameter of the machine, automatically start the auxiliary power unit if the parameter is outside a first predetermined range, and bring the parameter within a second predetermined range using the auxiliary power unit.

21 Claims, 4 Drawing Sheets

U.S. PATENT DOCUMENTS

| | | | | |
|---|---|---|---|---|
| 6,536,207 | B1 | 3/2003 | Kamen et al. | |
| 6,624,533 | B1 | 9/2003 | Swanson et al. | |
| 6,636,798 | B2 * | 10/2003 | Biess et al. | 701/112 |
| 6,651,759 | B1 | 11/2003 | Gruenwald et al. | |
| 6,850,037 | B2 | 2/2005 | Bertness | |
| 6,856,879 | B2 | 2/2005 | Arakawa et al. | |
| 6,928,972 | B2 * | 8/2005 | Biess et al. | 123/142.5 R |
| 7,013,646 | B1 * | 3/2006 | Serkh et al. | 60/698 |
| 2002/0174845 | A1 * | 11/2002 | Biess | 123/142.5 R |
| 2002/0189564 | A1 * | 12/2002 | Biess et al. | 123/142.5 R |
| 2004/0198254 | A1 | 10/2004 | Mizui et al. | |
| 2004/0199297 | A1 | 10/2004 | Schaper et al. | |
| 2005/0035657 | A1 * | 2/2005 | Brummett et al. | 307/10.1 |
| 2006/0071123 | A1 * | 4/2006 | Nguyen et al. | 244/76 R |
| 2006/0173586 | A1 * | 8/2006 | Swanson | 701/1 |

FOREIGN PATENT DOCUMENTS

| | | |
|---|---|---|
| EP | 1 440 855 | 7/2004 |
| EP | 1 441 077 | 7/2004 |
| WO | WO 96/11817 | 4/1996 |
| WO | WO 2004/025098 | 3/2004 |

* cited by examiner

AUTOMATIC START-UP OF AN AUXILIARY POWER UNIT

TECHNICAL FIELD

The present disclosure relates to machines having auxiliary power units, and more particularly, to the start-up of an auxiliary power unit of a machine.

BACKGROUND

Equipment such as on and off highway vehicles, construction equipment, and generator sets may be powered by a main engine. In addition to the main engine, a battery may also be provided to assist in powering the equipment. Often times, the battery may supply the initial charge necessary to start the main engine, and may also supply other equipment components with electrical power. These other components may include amenities, such as, for example, radios, televisions, and/or heating and cooling devices.

Vehicle operators/drivers may power equipment components using power from the battery when the main engine is turned off. However, this may quickly drain the battery. The main engine may be turned on to supply the necessary power so that battery charge may be conserved for other processes, such as starting the main engine. Thus, vehicle operators/drivers may run the main engines on their vehicles for the sole purpose of providing power for heating and cooling to the operator's cab. Operating the main engine for this sole purpose may be inefficient in terms of fuel consumption. Using an auxiliary power unit ("APU") may be a solution to this problem. It should be understood that APU may be referred to as a generator set ("gen-set"). The APU may include an auxiliary engine, separate from the main engine, which may supply power while the main engine is turned off. However, problems may still arise where vehicle operators/drivers draw power over the capabilities of the APU, requiring power from the battery, which may drain the battery, and in turn may lead to an inability to start the main engine.

At least one system has been developed to assist in assuring that the battery will have sufficient power for a main engine start. For example, U.S. Patent Application Publication 2005/0035657A1 to Brummett et al. ("Brummett") describes a vehicle including an APU for operating an auxiliary air conditioning and heating system. In Brummett, a voltage regulator of the APU can selectively disable electrical components in the event that the voltage of a main battery drops below a selected level. After disabling an electrical component when the voltage of the main battery decreases below a first preselected voltage, the voltage regulator enables power back to the electrical component when the voltage of the battery exceeds a second preselected voltage higher than the first preselected voltage. While the system in Brummett has an APU that is capable of selectively disabling the powering of various electrical components, it does not have an APU that automatically starts to recharge the main battery to help prevent a no-start condition. Furthermore, the system of Brummett does not take into account the fact that low engine coolant temperatures may also prevent a main engine start even when the battery has sufficient power for a main engine start.

The present disclosure is directed towards overcoming one or more of the problems set forth above.

SUMMARY OF THE INVENTION

In one aspect, the presently disclosed embodiments may be directed to an auxiliary power unit automatic start-up system configured to assist a main engine start of a machine. The auxiliary power unit automatic start-up system may include an auxiliary power unit and a controller. The controller may monitor a parameter of the machine, automatically start the auxiliary power unit if the parameter is outside a first predetermined range, and bring the parameter within a second predetermined range using the auxiliary power unit.

In another aspect, the presently disclosed embodiments may be directed to a method for automatically starting an auxiliary power unit to assist a main engine start of a machine. The method may include monitoring a parameter of the machine, automatically starting the auxiliary power unit if the parameter is outside a first predetermined range, and bringing the parameter within a second predetermined range using the auxiliary power unit.

In yet another aspect, the presently disclosed embodiments may be directed to a work machine. The work machine may include a main engine and an auxiliary power unit automatic start-up system. The auxiliary power unit automatic start-up system may include an auxiliary power unit configured to assist a main engine start of the machine and a controller. The controller may monitor a parameter of the machine, automatically start the auxiliary power unit if the parameter is outside a first predetermined range, and bring the parameter within a second predetermined range using the auxiliary power unit.

DETAILED DESCRIPTION

Figure 1:
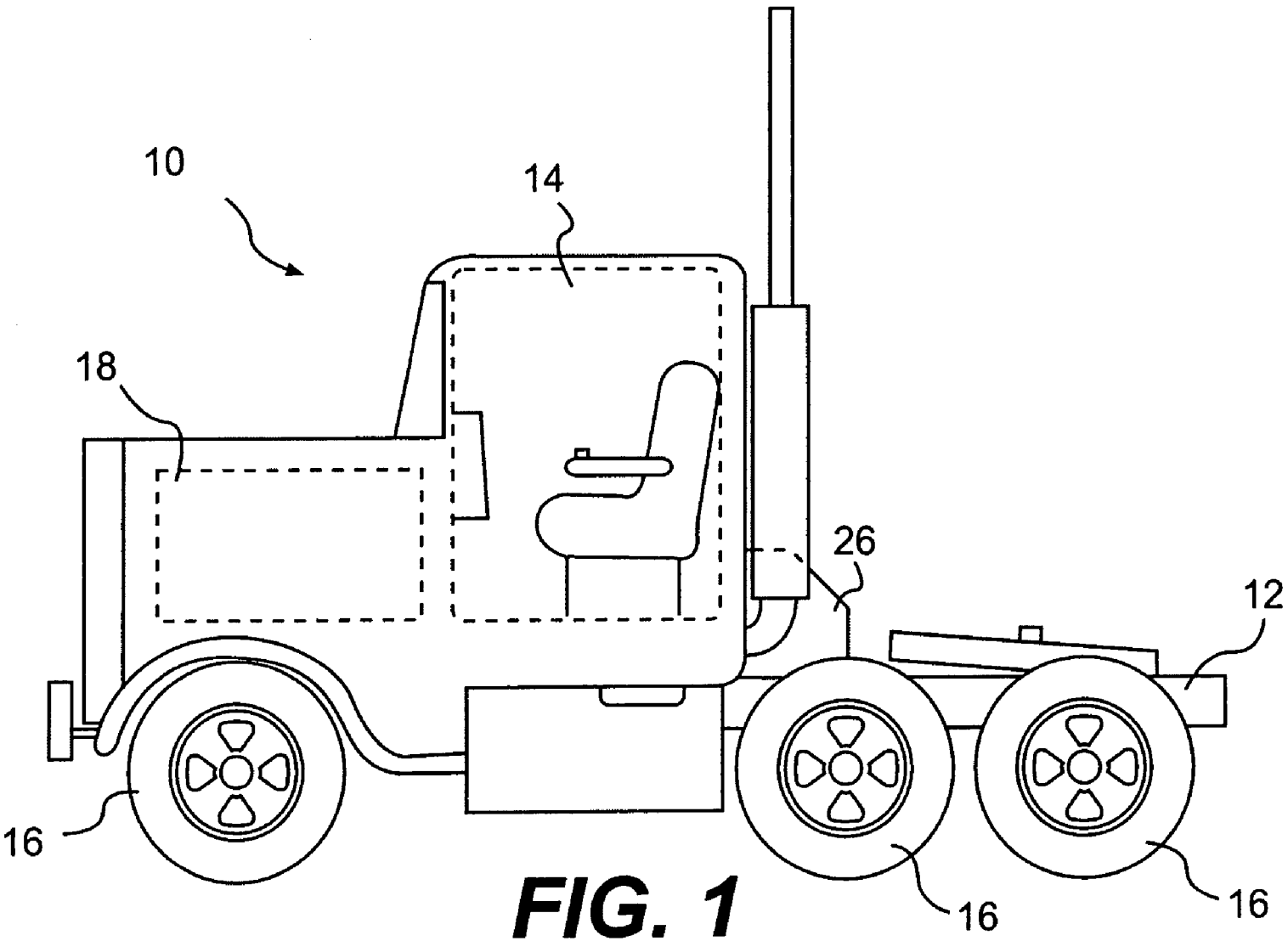
FIG. 1 is a diagrammatic view of a work machine, according to an exemplary disclosed embodiment.

FIG. 1 provides a diagrammatic view of a work machine 10 according to an exemplary disclosed embodiment. Work machine 10 may include a frame 12, a cab 14, and one or more traction devices 16. Work machine 10 may also include a main engine 18 and an auxiliary power unit (APU) 26 adapted to supply power to work machine 10 and its various components. While work machine 10 may be a truck, it is contemplated that the presently disclosed embodiment may be incorporated into any other work machine 10 that has an engine. For example, work machine 10 may include off-highway vehicles, passenger cars, construction equipment, and generator sets.

Figure 2:
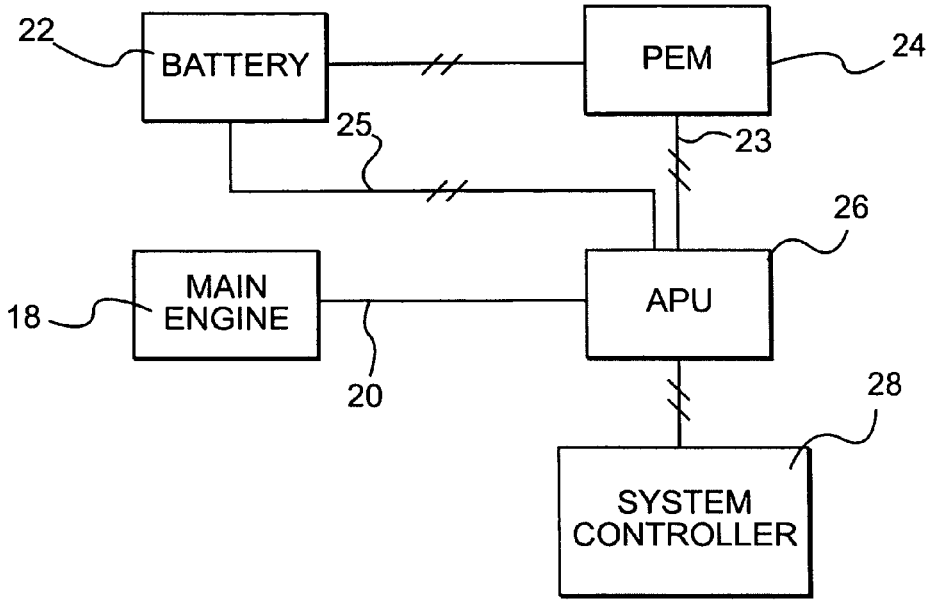
FIG. 2 is a block diagram of an auxiliary power unit automatic start-up system, according to an exemplary disclosed embodiment.

Main engine 18 may be configured to provide power to traction devices 16, and may also provide electrical power to devices inside cab 14 by way of a generator driven by main engine 18. Devices may include, for example, refrigerators, televisions, radios, or any other devices designed to provide comfort to an operator seated within cab 14. Main engine 18 may include an internal combustion engine that operates using diesel fuel, gasoline, gaseous fuels, or other types of fuel. FIG. 2 shows a schematic illustration of functional relationships between main engine 18 and other work machine components, including, for example, a cooling system 20, a battery 22, a power electronics module (PEM) 24, APU 26, and a system controller 28.

Cooling system 20 may circulate coolant through both main engine 18 and APU 26. In one embodiment, main engine 18 and APU 26 may share coolant to minimize cost/weight. Cooling system 20 may help to maintain stable main engine 18 and APU 26 temperatures under varying operating conditions. The circulation of the coolant may occur through the use of pipes, hoses, and/or coolant reservoirs 20. The coolant may be a liquid, and may include, for example, water, ethylene glycol, and other suitable solutions. In another embodiment, main engine 18 and APU 26 may not share coolant, but rather, may be individually supplied with coolant. In this embodiment, cooling system 20 may also include pumps to generate heat through friction, heaters, and/or other suitable devices. APU 26 may power the pumps, heaters, and/or other devices to affect the temperature of the coolant circulating through main engine 18.

Battery 22 may include any appropriate device for producing electricity by converting chemical energy. Battery 22 may provide an initial source of power for cranking main engine 18 during a main engine start. Thus, if the voltage of battery 22 falls outside a first predetermined range capable of providing the power for a main engine start, operator of work machine 10 may be unable to start main engine 18. Battery 22 may provide power to meet other electrical demands of work machine 10, such as radios, televisions, and/or heating and cooling devices (not shown). Battery 22 may be charged by power produced by main engine 18 and/or APU 26. As will be described in more detail below, APU 26 may be automatically started to provide power to battery 22 to help assure that the battery 22 has sufficient power to initiate the startup of main engine 18. It is understood that APU 26 and main engine 18 may include or be coupled to an appropriate generator (not shown) to convert mechanical power to electrical power.

Battery 22 may be operatively connected to APU 26 by PEM 24. When main engine 18 is turned off, APU 26 may generate a voltage, for example, 340 VDC applied to PEM 24 through an electrical connection 23, PEM 24 may include power converters that may convert the voltage into lower voltages that may be used to recharge battery 22 or power components that may not require or cannot handle the full voltage. For example, PEM 24 may convert the 340 VDC into a voltage of 14.2 VDC, or any other suitable voltage value that may be used to recharge battery 22. In low temperature conditions, where battery 22 may be better able to hold its charge, but coolant temperature is undesirably low, PEM 24 may convert the 340 VDC into a lower voltage of 13.5 VDC, or any other suitable voltage value. The lower voltage may assure that battery 22 will not be damaged by overcharging when APU 26 is used to heat the coolant.

Additionally or alternatively, APU 26 may be operatively connected to battery 22 through electrical connection 25. Electrical connection 25 may include a low voltage belt driven alternator connected to APU 26. The low voltage belt driven alternator may provide a suitable voltage to charge battery 22 without the need to use PEM 24 as an intermediary.

In addition to recharging battery 22, APU 26 may power components, such as, for example, HVAC systems (not shown), to create a comfortable cab environment for a work machine operator. APU 26 may be mounted on or within work machine 10, and may include an auxiliary engine, which may include a smaller internal combustion engine separate from main engine 18 that may operate using diesel fuel, gasoline, gaseous fuels, or other types of fuel. The initial source of power for starting APU 26 may come from battery 22 (APU 26 may require less voltage to start than main engine 18), a rechargeable APU battery (not shown) operatively connected to APU 26, and/or from any suitable external power source. Once started, the auxiliary engine may run at multiple speeds to deliver varying amounts of power. At lower speeds, the auxiliary engine may yield lower fuel consumption, decreased emissions, and minimal noise/vibration. At higher speeds, the auxiliary engine may produce more power. Like most engines, the auxiliary engine may generate a certain amount of heat while it runs. This heat may have the effect of warming the coolant in or around the auxiliary engine before it circulates through main engine 18. It is also contemplated that APU 26 may provide power to warmers, pumps, and/or other suitable devices to warm engine coolant circulating through main engine 18.

Figure 3:
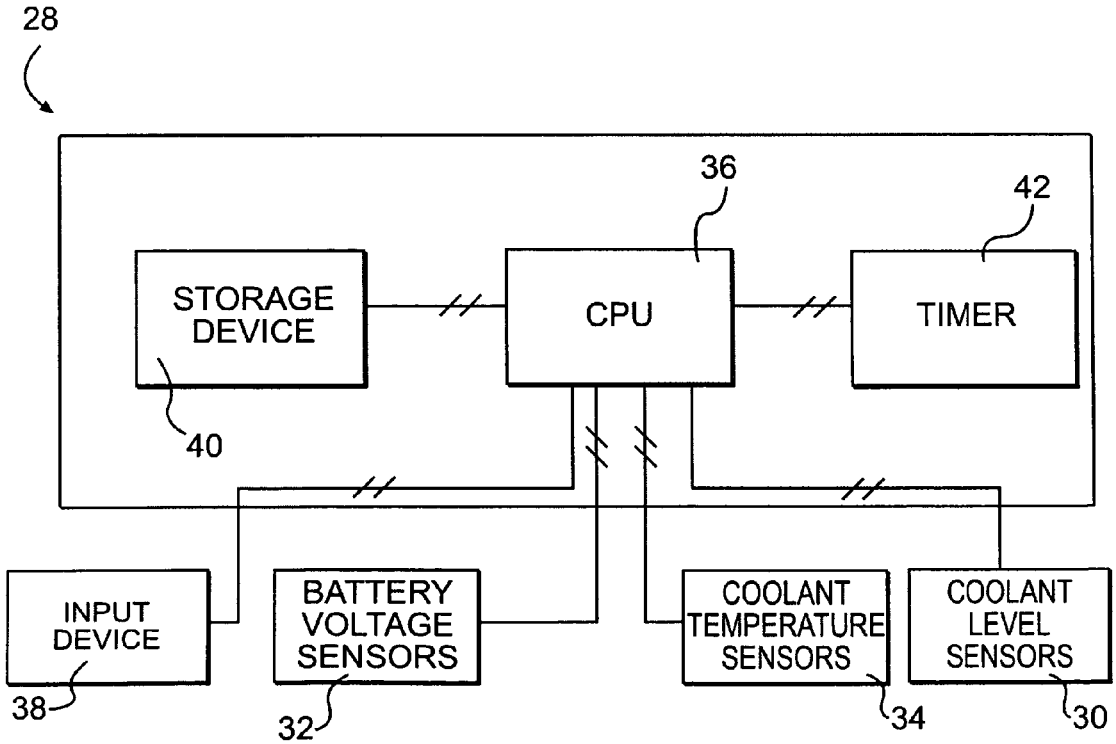
FIG. 3 is a block diagram a system controller, according to an exemplary disclosed embodiment.

System controller 28, depicted in FIG. 3, may include hardware and software adapted to assist the initial start-up of main engine 18 by automatically activating and deactivating APU 26. System controller 28 may perform actions based upon the condition of battery 22 and/or cooling system 20, as reported by one or more coolant level sensors 30, battery voltage sensors 32, and/or coolant temperature sensors 34. Other components of system controller 28 may include a central processing unit (CPU) 36, an input device 38, a storage device 40, and a timer 42. It is contemplated that system controller 28 may include additional, fewer, and/or different components than what is listed above. It is understood that the type and number of listed devices are exemplary only and not intended to be limiting.

Battery voltage sensors 32 may be placed on or around battery 22, or they may be attached to appropriate electrical circuits to acquire information regarding battery voltage and relay the information to system controller 28. Coolant temperature sensors 34 may be placed into contact with the coolant flowing through cooling system 20 to acquire information regarding coolant temperature and relay the information to system controller 28. Coolant temperature may be determined without the use of coolant temperature sensors 34 by determining the temperature of nearby components and/or the surroundings. Coolant level sensors 30 may be placed into contact with the coolant flowing through cooling system 20 to acquire information regarding coolant level and relay the information to system controller 28.

CPU 36 may be configured to execute sequences of computer program instructions to perform the automatic activation and deactivation of APU 26. The computer program instructions may be loaded into random access memory (RAM) for execution by CPU 36 from read only memory (ROM). Depending on the type of computer system being used, CPU 36 may include one or more printed circuit boards, and/or a microprocessor chip.

Input device 38 may receive data and instructions from users. Input device 38 may include, for example, a keyboard, a mouse, or other optical or wireless computer input devices. Additionally or alternatively, input device 38 may include floppy disk drives, optical disk drives, or any other suitable computer storage medium reading apparatus.

Storage device 40 may be an appropriate type of mass storage provided to store information that CPU 36 may require in order to perform the automatic activation and deactivation of APU 26. For example, storage device 40 may include one or more hard disk drive devices, optical disk drive devices, or other storage devices to provide electronic storage space.

Timer 42 may be configured to time the duration that APU 26 has run after automatic activation of APU 26. System controller 28 may automatically deactivate APU 26 after it has run for a predetermined period of time. The predetermined period of time may be set by a machine operator, dealer, manufacturer, and/or service provider. Providing the predetermined period of time may prevent energy waste, while also providing a safeguard against overcharging and/or overheating. It is further contemplated that timer 42 may include a plurality of timing devices, each configured to time the durations of different events.

Additionally, the operator of work machine 10 may selectively choose whether to allow system controller 28 to initiate the automatic activation and deactivation of APU 26. For example, cab 14 may include a switch (not shown) that the operator may use to enable or disable the automatic activation of APU 26. This may assure that automatic activation of APU 26 will not occur at inopportune moments, such as during APU 26 repair and/or maintenance.

INDUSTRIAL APPLICABILITY

The disclosed system and method of automatically activating and deactivating APU 26 may be used on equipment that relies on a battery as its initial starting power source. It is also contemplated that the process may be used on equipment that may utilize a liquid cooling process to cool one or more engines. Examples of equipment using the disclosed structure and processes may include on and off highway vehicles (trucks, boats, recreational vehicles, passenger cars), industrial/construction equipment, and generator sets. In one exemplary disclosed embodiment, the automatic activation and deactivation of APU 26 may be controlled by system controller 28.

Figure 4:
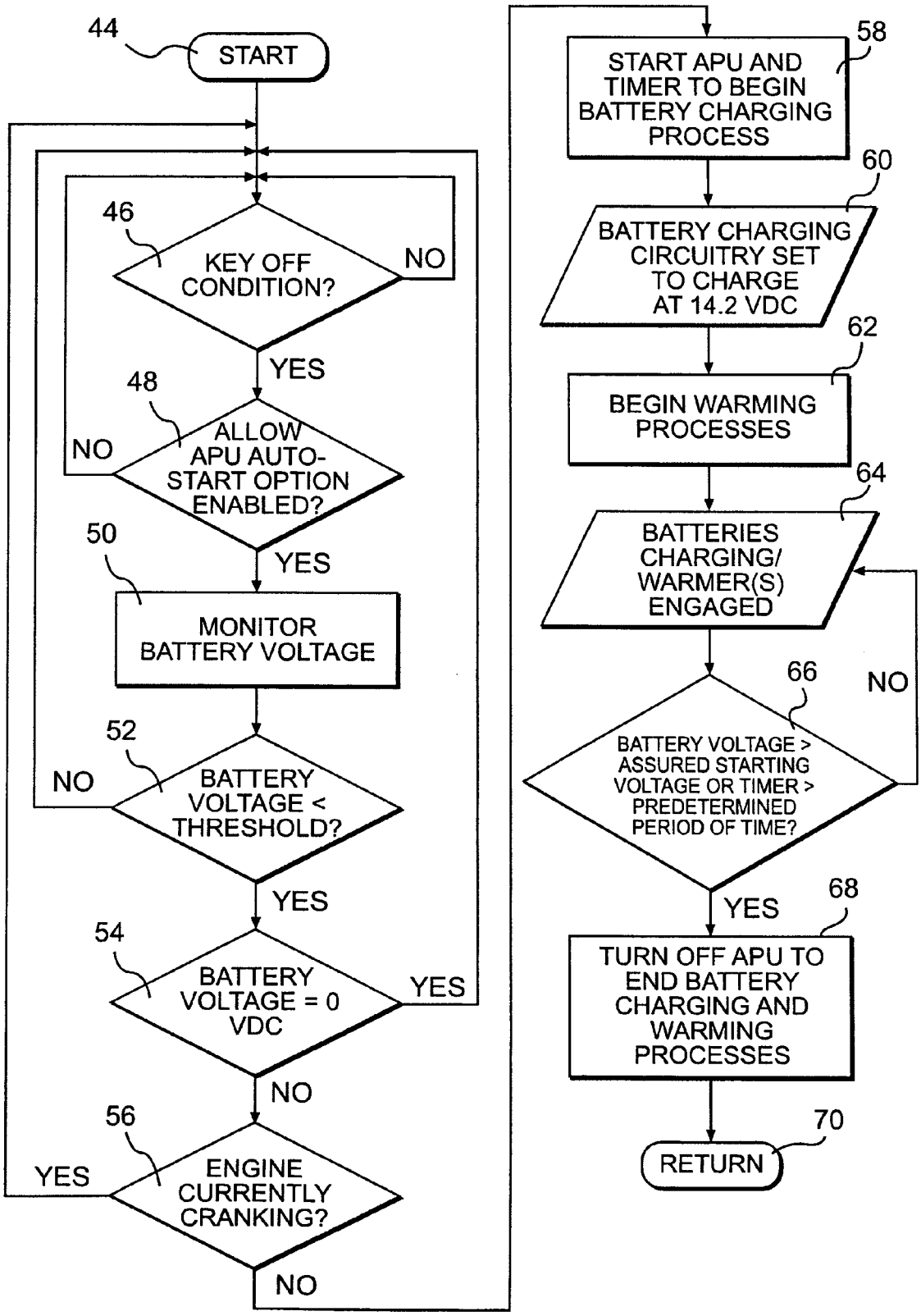
FIG. 4 is a flow diagram of a method of activating and deactivating an auxiliary power unit, according to an exemplary disclosed embodiment.

In one embodiment shown in FIG. 4, the method for automatically activating and deactivating APU 26 may begin (step 44) with a determination of whether a key off condition exists (step 46). A key on condition may indicate that the operator of work machine 10 may be attempting to crank main engine 18. If the key on condition exists, then a value of "false" may be returned to system controller 28, and the automatic activation of APU 26 may be prevented. This may be a requirement because the voltage of battery 22 may collapse as main engine 18 begins cranking, and may normally trigger the automatic activation of APU 26. However, the key off condition check (step 46) may prevent automatic activation so that APU 26 does not automatically start every time a main engine start is attempted. This feature may ensure that voltage levels will not exceed manufacturer specifications by preventing APU 26 from automatically starting when power from APU 26 is not desirable.

Once the key off condition is recognized, the next step may involve determining whether the automatic activation option is enabled (step 48). As noted above, the operator may have the choice of allowing the automatic activation of APU 26 to occur, or to prevent it from occurring to ensure that APU 26 will not automatically start at inopportune moments, such as during maintenance or repair. The automatic activation option may be enabled or disabled through the use of a switch located, for example, in cab 14.

Next, the battery voltage, or any value indicative thereof, may be monitored (step 50) to determine whether it is outside a first predetermined range (step 52). If it is determined that the battery voltage is within the first predetermined range, then the process may return to start (step 44) because battery 22 may not require charging, and thus, APU 26 need not be activated. However, if it is determined that the battery voltage is outside the first predetermined range, then system controller 28 may check to determine if the voltage of battery 22 is equal to zero (step 54). The voltage of battery 22 may equal zero if battery 22 is removed while the automatic activation option is enabled. A situation where this may occur is during servicing and/or battery replacement, when battery 22 is disconnected or removed. This check may help to ensure that APU 26 will not automatically activate at undesirable times. If battery 22 is disconnected, then the zero value for the voltage of the battery may be readily explained, and battery charging may not be required. Therefore the process may once again return to start (step 44).

If it is determined that the voltage of battery 22 is outside the first predetermined range, but greater than zero, then the next step may involve determining whether engine 18 is currently cranking (step 56). If engine 18 is currently cranking, then the automatic activation of APU 26 may be prevented. As previously explained, this step may be helpful because the voltage of battery 22 may collapse as main engine 18 begins cranking, and may normally trigger the automatic activation of APU 26. However, checking to determine if engine cranking is causing the low voltage may help to ensure that APU 26 does not automatically start every time a main engine start is attempted and/or performed. This feature may act as a safeguard ensuring that voltage levels will not exceed manufacturer specifications by preventing APU 26 from automatically starting when power from APU 26 is undesirable.

If the operator is not attempting to crank main engine 18, then the low voltage value may indicate to system controller 28 that battery charging may be necessary to ensure a successful main engine start. Thus, battery charging may begin (step 58), and system controller 28 may automatically activate APU 26 and timer 42. PEM 24 may convert the usual voltage output of APU 26 to a voltage that may provide the proper charging for battery 22 (step 60). For example, voltage output of APU 26 may be 340 VDC, while the voltage for charging may be 14.2 VDC. However, any other suitable range of voltage values may be applied. Warming processes may also begin (steps 62 and 64), and APU 26 may power other devices, including, for example, a battery warmer, cab warmer, and/or block heater. In addition, APU 26 may generate heat while running, which may provide the added benefit of warming the coolant in cooling system 20. Additionally or alternatively, APU 26 may power other pumps and/or heaters (not shown) to warm the coolant circulating through main engine 18. The charging and warming processes may continue until system controller 28 determines that the battery voltage is within a second predetermined range (step 66). It is contemplated that the second predetermined range may be equal to the first predetermined range, or may differ from the first predetermined range in terms of minimum value, maximum value, and/or values therebetween. Additionally or alternatively, charging and warming processes may cease after continuing for a predetermined period of time (step 66). Afterwards, the APU may be deactivated (step 68) and the process may return (step 70) to start (step 44).

Figure 5:
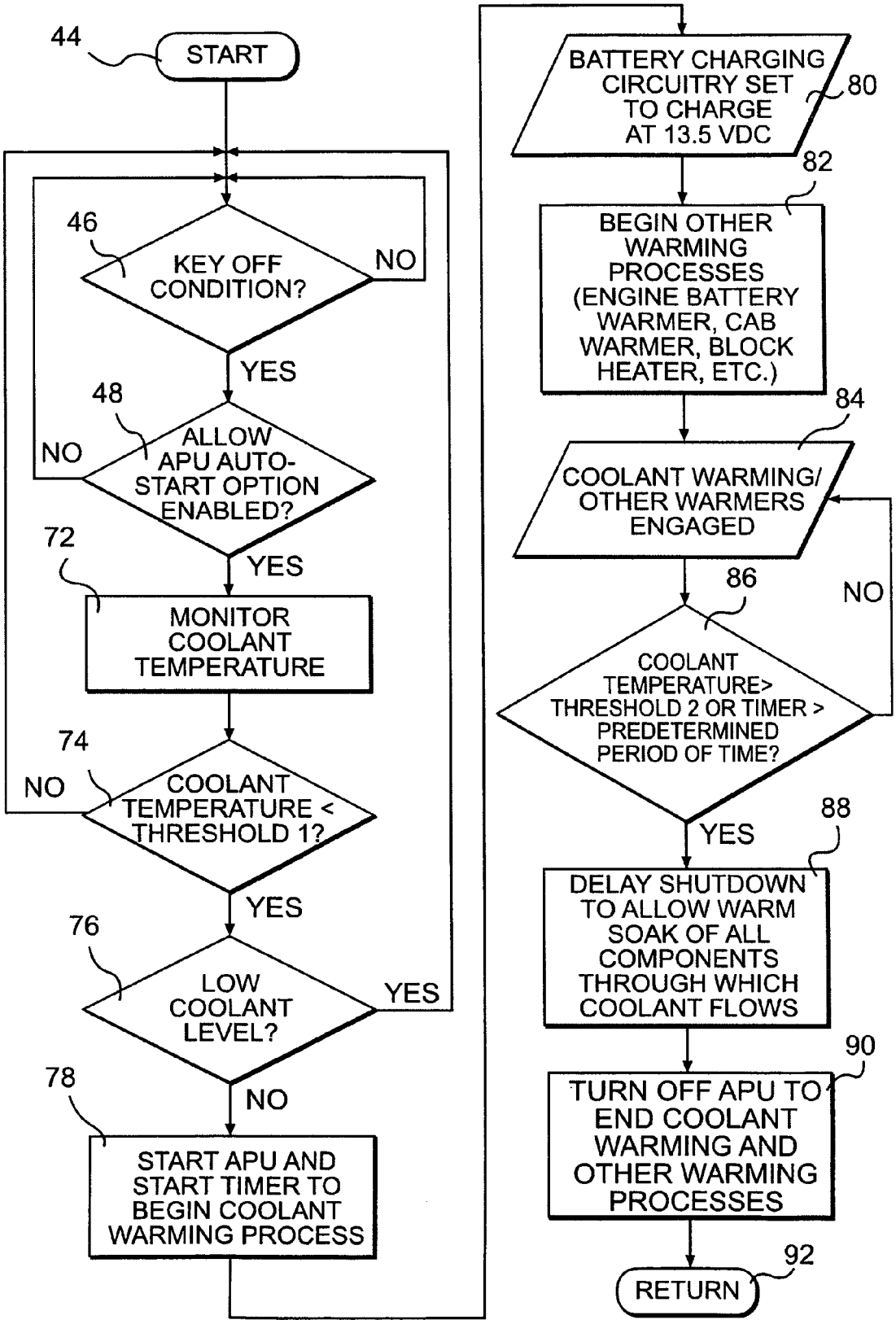
FIG. 5 is a flow diagram of another method of activating and deactivating an auxiliary power unit, according to another exemplary disclosed embodiment.

In another embodiment, the automatic activation and deactivation of APU 26 may be triggered by coolant temperature as opposed to battery voltage. Low coolant temperature may hinder a main engine start, and thus may be undesirable. This may be addressed by the method shown in FIG. 5, which may begin (steps 44, 46, and 48) in a similar manner as the process described in FIG. 4. System controller 28 may monitor coolant temperature (step 72) and determine whether the coolant temperature, or any value indicative thereof, is outside a first predetermined range (step 74). System controller 28 may also determine whether there is sufficient coolant in cooling system 20 (step 76). Then system controller 28 may begin warming the coolant by automatically activating APU 26 to generate heat and initiating timer 42 for timing the duration of the warming process (step 78). Additionally or alternatively, the coolant circulating through main engine 18 may be separate from the coolant circulating through APU 26. In that case, APU 26 may be activated to power other heaters and/or pumps (not shown) that may heat the coolant in main engine 18 to provide a similar warming effect.

PEM 24 may convert the usual voltage output of APU 26 to a lower voltage to provide the proper coolant warming (step 80) and battery charging without overcharging battery 22. For example, voltage output of APU 26 may be 340 VDC, while the lower voltage generated when coolant warming is desired may be 13.5 VDC. However, any other suitable range of voltages may be included. The lower voltage may be less than or equal to the voltage generated when charging the batteries, because in low temperature environments, where system controller 28 may automatically activate APU 26 frequently to keep the coolant warm, battery 22 may not be losing much charge (since batteries tend to hold charge better at low temperatures) and may require less charging than in high temperature environments. Thus, the lower voltage may prevent overcharging, which may damage battery 22.

Other warming processes may also be initiated (steps 82 and 84), and all warming processes and/or some or all warmers may continue to run until system controller 28 determines that warming has continued for a predetermined period of time (step 86) or the coolant temperature is within a second predetermined range (step 86). It is contemplated that the second predetermined range may be equal to the first predetermined range, or may differ from the first predetermined range in terms of minimum value, maximum value, and/or values therebetween. However, the process may not automatically cease upon occurrence of the condition. Rather, the process may continue to allow a warm soak of all components through which the coolant may flow (step 88) for another predetermined period of time, as measured by timer 42 and/or one or more of a plurality of other timers. Afterwards, the process may end (step 90) and return (step 92) to start (step 44).

System controller 28 may monitor both coolant temperature (FIG. 5) and battery voltage (FIG. 4) simultaneously, and may recognize the first of those values to fall outside a first predetermined range as a trigger. The elements of steps 50 through 66 of FIG. 4 may represent a first mode triggered by the battery voltage. Alternatively, the elements of steps 72 through 90 of FIG. 5 may represent a second mode triggered by low coolant temperature. However, both modes may result in some battery charging and coolant warming whenever APU 26 is automatically activated.

The presently disclosed system and method for automatically activating and deactivating APU 26 may have several advantages and benefits. For example, the present disclosure may help to assure that the battery voltage necessary for a main engine start may be maintained, thus assuring that main engine 18 will start upon request. This may help to avoid the scenario where a main engine start cannot be achieved, which may require an expensive and time consuming jump-start or tow to a repair facility.

Another benefit may be that the disclosed embodiments may contribute to longer life cycles for work machine components, and less frequent maintenance/repair. A machine owner may be able to reduce battery maintenance intervals, extend battery life, and therefore improve owning and operating costs. Also, the likelihood of starter solenoid damage due to low voltage during starting may decrease, thus extending starter life. Further, when APU 26 warms the coolant, it may help main engine 18 turn over easier, which may reduce wear on starting components in extreme weather conditions.

It will be apparent to those skilled in the art that various modifications and variations can be made in the disclosed system and method without departing from the scope of the disclosure. Additionally, other embodiments of the disclosed system and methods will be apparent to those skilled in the art from consideration of the specification. It is intended that the specification and examples be considered as exemplary only, with a true scope of the disclosure being indicated by the following claims and their equivalents.

What is claimed is:

1. An auxiliary power unit automatic start-up system configured to assist a main engine start of a machine, comprising:

an auxiliary power unit assembly configured to supply a variable level of output; and a controller configured to:

monitor a parameter of the machine;

automatically start the auxiliary power unit assembly if the parameter is outside a first predetermined range; and bring the parameter within a second predetermined range using the auxiliary power unit assembly.

2. The system of claim 1, wherein the parameter affects the starting of the main engine.

3. The system of claim 1, wherein the auxiliary power unit assembly is configured to supply charge to a battery, and the parameter is indicative of a voltage of the battery.

4. The system of claim 1, wherein the auxiliary power unit assembly is configured to warm a coolant of a cooling system of the machine, and the parameter is indicative of a temperature of the coolant.

5. The system of claim 4, wherein the auxiliary power unit assembly shares coolant with the main engine.

6. The system of claim 1, wherein the first predetermined range and the second predetermined range are different.

7. A method for automatically starting an auxiliary power unit assembly to assist a main engine start of a machine, the method comprising:

monitoring a first parameter of the machine;

monitoring a second parameter of the machine;

automatically starting the auxiliary power unit assembly to operate in a first mode if the first parameter falls outside a first predetermined range before the second parameter falls outside a second predetermined range; and automatically starting the auxiliary power unit assembly to operate in a second mode if the second parameter falls outside the second predetermined range before the first parameter falls outside the first predetermined range.

8. The method of claim 7, wherein the first and second parameters affect the starting of the main engine.

9. The method of claim 7, wherein the first parameter is indicative of a voltage of the battery, and the second parameter is indicative of a temperature of a coolant.

10. The method of claim 7, wherein the first mode is a battery charging mode.

11. The method of claim 7, wherein the second mode is a coolant warming mode.

12. The method of claim 7, wherein the auxiliary power unit assembly is prevented from starting when the main engine is cranking.

13. The method of claim 7, wherein operating in the first mode includes bringing the first parameter within a first target range.

14. The method of claim 13, wherein the first predetermined range and the first target range are different.

15. The method of claim 7, wherein operating in the second mode includes bringing the second parameter within a second target range.

16. The method of claim 15, wherein the second predetermined range and the second target range are different.

17. A work machine comprising:

a main engine; and an auxiliary power unit automatic start-up system, comprising:

an auxiliary power unit assembly configured to supply a variable level of output when assisting a main engine start of the machine; and a controller configured to:

monitor a parameter of the machine;

automatically start the auxiliary power unit assembly if the parameter is outside a first predetermined range; and bring the parameter within a second predetermined range using the auxiliary power unit assembly.

18. The work machine of claim 17, further including a battery configured to assist in starting the main engine.

19. The work machine of claim 17, further including a cooling system configured to circulate a coolant through the main engine and the auxiliary power unit assembly.

20. The work machine of claim 17, wherein the first predetermined range and the second predetermined range are different.

21. The work machine of claim 17, further including:

a battery voltage sensor configured to provide information to the controller; and a coolant temperature sensor configured to provide information to the controller.

* * * * *